US006083120A

United States Patent [19]

Umezawa et al.

[11] Patent Number: 6,083,120

[45] Date of Patent: Jul. 4, 2000

[54] WOUND GOLF BALL

[75] Inventors: Junji Umezawa; Shinichi Kakiuchi, both of Chichibu, Japan

[73] Assignee: Bridgestone Corporation, Tokyo, Japan

[21] Appl. No.: 09/129,884

[22] Filed: Aug. 6, 1998

[30] Foreign Application Priority Data

Aug. 11, 1997 [JP] Japan ..... 9-228900

[51] Int. Cl.[7] ..... A63B 37/06

[52] U.S. Cl. ..... 473/356

[58] Field of Search ..... 473/357, 365, 473/356; 273/DIG. 9

[56] References Cited

U.S. PATENT DOCUMENTS

| | | | |
|---|---|---|---|
| 5,800,286 | 9/1998 | Kakiuchi et al. | 473/365 |
| 5,813,923 | 9/1998 | Cavallaro et al. | 473/378 X |

FOREIGN PATENT DOCUMENTS

| | | |
|---|---|---|
| 2-51544 | 2/1990 | Japan . |
| 2-159285 | 6/1990 | Japan . |
| 6-504308 | 5/1994 | Japan . |
| 6-192512 | 7/1994 | Japan . |
| 6-299052 | 10/1994 | Japan . |

*Primary Examiner*—Jeanette Chapman
*Assistant Examiner*—Raeann Gorden
*Attorney, Agent, or Firm*—Sughrue, Mion, Zinn, Macpeak & Seas, PLLC

[57] ABSTRACT

A wound golf ball includes a solid center, a thread rubber layer, and a cover. The solid center is composed mainly of a thermoplastic polyester elastomer and has an outer diameter of 31–34 mm, a deflection of 1.8–4.5 mm under an applied load of 50 kg, and a rebound height of 95–105 cm when dropped from a height of 120 cm. The cover has a specific gravity of 1.05–1.4 and a gage of 1.5–3 mm. When solid centers are molded using a mold having a number of cavities, little variations occur with respect to hardness and weight. Golf balls of consistent quality are obtained.

10 Claims, 1 Drawing Sheet

WOUND GOLF BALL

BACKGROUND OF THE INVENTION

1. Technical Field

This invention relates to a wound golf ball of consistent quality featuring distance and controllability.

2. Prior Art

Wound golf balls are generally classified into two types, solid center balls and liquid center balls. The solid centers are generally formed by molding high cis-polybutadiene base compounds, which are crosslinked with metal salts of unsaturated carboxylic acids such as zinc acrylate or sulfur. The liquid centers are generally formed by filling center bags of natural rubber base compounds with a liquid such as water or barium sulfate paste.

For improvements in wound golf balls, a number of proposals have been made with respect to the compounds and geometry of centers. For example, JP-A 51544/1990, 192512/1994, 299052/1994, and 504308/1994 disclose thermoplastic polyester elastomer base compositions of which solid centers are molded. JP-A 159285/1990 discloses a golf ball core stock containing more than about 50% by weight of a fluoro-resin.

In most molding processes, the number of cavities in a mold is increased from the standpoint of production yield. Typically about 20 to about 50 solid centers are prepared per mold. When the solid centers prepared from a single mold are compared, substantial variations are found among them with respect to hardness, weight and outer diameter. These variations among solid centers have a substantial influence on the weight and hardness of balls prepared therefrom, becoming a bar against the mass-scale production of balls of consistent quality.

Also, for improvement in golf balls, a number of modifications have been made on the cover stock. For example, JP-B 44303/1993 discloses a cover stock comprising an ionomer resin loaded with an inorganic white pigment containing at least 60% by weight based on the white pigment of barium sulfate having a particle size of 1 to 10 $\mu$m. Japanese Patent Application No. 76557/1997 discloses a multi-layer cover including a first cover layer based on a thermoplastic polyurethane and a second cover layer based on Surlyn.

Under these circumstances, the wound golf balls are required not only to solve the problems associated with the solid center, but also to form an appropriate cover.

SUMMARY OF THE INVENTION

An object of the present invention is to provide a wound golf ball featuring distance and controllability and of consistent quality due to minimized variations of hardness and weight.

Regarding a wound golf ball comprising a wound core consisting of a solid center and a thread rubber layer formed by winding thread rubber on the solid center, and a cover surrounding the wound core, we have found that by forming the solid center mainly from a thermoplastic polyester elastomer and controlling optimum the outer diameter, deflection under a load, and rebound height of the solid center as well as the specific gravity and gage of the cover, the ball is improved in flight distance and controllability. In the manufacture of solid centers, when solid centers are molded in a mold having a number of cavities, little variations occur with respect to hardness and weight. This permits golf balls to be manufactured to consistent quality.

When the solid center is roughened at its surface, a rubber thread can be easily wound on the solid center. This feature is advantageous to the manufacturing process.

Accordingly, the present invention provides a wound golf ball comprising a wound core consisting of a solid center and a thread rubber layer thereon, and a cover surrounding the wound core. The solid center is composed mainly of a thermoplastic polyester elastomer and has an outer diameter of 31 to 34 mm, a deflection of 1.8 to 4.5 mm under an applied load of 50 kg, and a rebound height of 95 to 105 cm when dropped from a height of 120 cm. The cover has a specific gravity of 1.05 to 1.4 and a gage of 1.5 to 3 mm. In one preferred embodiment, the solid center is provided at its surface with fine asperities.

DETAILED DESCRIPTION OF THE INVENTION

Figure 1:
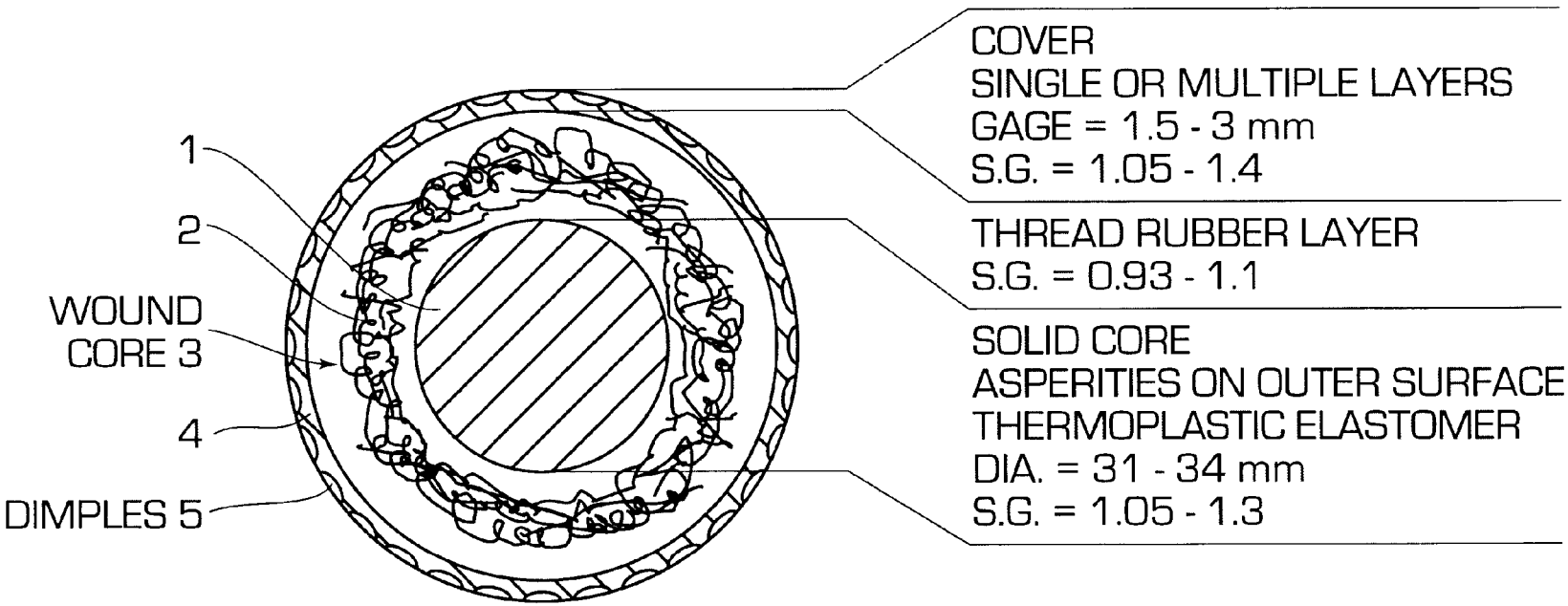
FIG. 1 is a cross-section of the golf ball of this invention.

The golf ball of the invention is illustrated in FIG. 1 includes a wound core 3 and a cover 4 surrounding the wound core. The wound core consists of a solid center 1 and a thread rubber layer 2 formed by winding thread rubber on the solid center.

First, the solid center is described in detail. The solid center used herein is formed of a composition based on a thermoplastic polyester elastomer. This solid center allows the ball to travel a longer distance and minimizes the variations of weight and hardness when solid centers are molded using a mold having a number of cavities.

The thermoplastic polyester elastomer used herein may be any of well-known elastomers, preferably elastomers consisting of hard segments of polybutylene terephthalate (PBT) or polybutylene naphthalate (PBN) and soft segments of polytetramethylene ether glycol (PTMG) or the like. Such elastomers may be used alone or in admixture of two or more. They are commercially available under the trade name of Hytrel 4001 and Hytrel 3078 from Toray-DuPont K.K.

In the solid center-forming composition based on the thermoplastic polyester elastomer, various additives may be blended if desired. As the additive, for example, inorganic fillers such as zinc oxide and barium sulfate may be blended for weight adjustment. An appropriate amount of the inorganic filler blended for improving the resilience of the golf ball is less than about 20 parts, especially 0 to about 10 parts by weight per 100 parts by weight of the thermoplastic polyester elastomer.

Using the thermoplastic polyester elastomer base composition, the solid center is formed to an outer diameter of 31 to 34 mm, preferably 32 to 33 mm, a deflection under an applied load of 50 kg of 1.8 to 4.5 mm, preferably 2.0 to 4.0 mm, and a rebound height of 95 to 105 cm when dropped from a height of 120 cm. If the outer diameter, deflection and rebound height are outside the specific ranges, the flight distance may become short. Further preferably, the solid center is formed to a specific gravity of 1.05 to 1.3, especially 1.05 to 1.25 although the specific gravity of the solid center is not critical.

The solid center can be prepared by conventional methods, for example, by injection molding the composition into a mold cavity. The solid center thus molded has a high degree of homogeneity of material. Then when solid centers are molded in a common mold having a number of cavities, the variations in hardness and weight among the solid centers are minimized. This is advantageous for manufacturing golf balls of consistent quality.

The thus formed solid center preferably has a finely irregular surface, that is, a spherical surface having fine asperities. Such asperities are given to the solid center surface by several methods, for example, injection molding using a mold whose cavity surface is provided with a negative asperity pattern. Alternatively, the molded solid center is surface treated as by barrel polishing to form asperities. The finely roughened surface of the solid center facilitates winding of thread rubber, contributing to productivity.

In the wound golf ball of the invention, thread rubber is wound on the above-mentioned solid center to form a wound core. The method of winding thread rubber on the solid center is not critical although it is preferred that a rubber thread having a specific gravity of 0.93 to 1.1, especially 0.93 to 1, a width of 1.4 to 2 mm, especially 1.5 to 1.7 mm, and a thickness of 0.3 to 0.7 mm, especially 0.4 to 0.6 mm be wound to a stretching factor of about 7 to 10 folds.

In the golf ball of the invention, the wound core is enclosed with a cover. The cover should have a specific gravity of 1.05 to 1.4, especially 1.05 to 1.25 and a gage of 1.5 to 3 mm, especially 1.5 to 2.5 mm. If the cover specific gravity is less than 1.05, the ball becomes lighter and more likely to be affected by the wind during flight. If the cover specific gravity is greater than 1.4, the initial velocity becomes low and the cover can be damaged when hit with an iron. If the cover 4 is thinner than 1.5 mm, it becomes more susceptible to cutting and less durable. If the cover 4 is thicker than 3 mm, the initial velocity would become low for distance and the feel of the ball when hit would become too soft.

The cover 4 may be a single layer or a multilayer structure including two or more layers. In the case of the multilayer structure, the respective layers are formed such that the overall cover may meet the above-defined requirements of specific gravity and gage. A two-layer structure cover consisting of an inner layer and an outer layer is especially preferred in the practice of the invention. The ratio in thickness of the inner layer to the outer layer desirably ranges from 7:3 to 3:7.

The cover 4 may be formed of well-known cover stocks. The base is not critical and there may be used ionomer resins and thermoplastic polyurethane elastomers, for example. Where the cover is formed to a two-layer structure consisting of inner and outer layers, it is recommended that the inner layer be formed of an ionomer resin and the outer layer formed of a non-yellowing thermoplastic polyurethane elastomer because fretting damage on the cover by iron shots can be reduced and the initial velocity can be increased to extend the distance.

In the cover stock, various additives may be blended. for example, fillers such as zinc oxide, barium sulfate and titanium oxide may be blended. The amount of such additive blended is not critical insofar as the cover's specific gravity falls within the above-defined range. When the specific gravity of the cover falling within the above-defined range is higher than the specific gravity of the solid center, the ball can be increased in moment of inertia and hence, distance. When fillers such as zinc oxide, barium sulfate and titanium oxide are blended, there is a likelihood of reducing the resilience and flow of the cover stock. In this regard, it is recommended to blend barium sulfate in amounts of less than about 50 parts, especially 0 to about 40 parts by weight per 100 parts by weight of the cover base.

In the invention, the hardness of the cover 4 is not critical. Preferably the cover is formed to a Shore D hardness of 55 to 65, especially 58 to 65. Where the cover is formed to a two-layer structure consisting of inner and outer layers, the outer layer is preferably formed harder than the inner layer for improving the ball control on iron shots. For example, the cover inner layer may be formed to a Shore D hardness of 55 to 65, especially 58 to 65, and the cover outer layer be formed to a Shore D hardness of 38 to 55, especially 42 to 53. It is recommended that the difference in hardness between the inner layer and the outer layer be at least 5 Shore D hardness units, especially 5 to 20 Shore D hardness units.

In the practice of the invention, the cover may be formed by well-known methods. For example, the wound core is placed in an injection mold whereupon the cover stock is injected into the mold cavity. Alternatively, a pair of hemispherical half cups are preformed from the cover stock, and the wound core is enclosed in the pair of half cups, which are compression molded.

Like conventional golf balls, the wound golf ball of the invention is formed with a multiplicity of dimples 5 in the outer surface of the cover 4. The dimples can be optimized by various dimple tailoring methods for the purpose of increasing the moment of inertia and flight distance.

For example, dimples 5 are preferably formed so as to provide a dimple surface coverage of at least 65%, and preferably 70 to 80%. The dimple surface coverage is the sum of dimple areas divided by the entire surface area of the hypothetical spherical surface of the ball which is regarded as a smooth sphere. When the percent dimple surface coverage is less than 65%, it may not be possible to obtain the outstanding flight characteristics.

Moreover, the percent dimple volume may be set at 0.76 to 1%, and preferably 0.78 to 0.94%. The percent dimple volume is (total dimple volume)/(ball volume)×100 wherein "ball volume" refers to the volume of the spherical ball when one imagines the surface of the golf ball to be free of dimples, and "total dimple volume" refers to the sum of the volumes of the individual dimples. When the percent dimple volume is less than 0.76%, the ball may travel a too high trajectory, resulting in a shorter carry. When the dimple volume ratio is greater than 1%, the trajectory may become too low, similarly resulting in a shorter carry.

The number of dimples 5 is preferably from 350 to 500, more preferably from 370 to 480, and most preferably from 390 to 450. No particular limits are imposed on the diameter, depth, cross-sectional shape and arrangement of dimples. Typically, the diameter may be set within a range of 1.4 to 2.2 mm and the depth be set within a range of 0.15 to 0.25 mm. Known arrangements such as octahedral, dodecahedral and icosahedral arrangements may be employed.

The inventive wound golf balls constructed as described above preferably have a ball hardness corresponding to a deflection of 2.4 to 3.6 mm, and especially 2.6 to 3.4 mm under a load of 100 kg.

The wound golf balls of the invention must have a diameter and weight in accordance with the Rules of Golf, specifically a diameter of not less than 42.67 mm and a weight of not greater than 45.93 g. Since balls with a weight of less than 44 g can be affected by the wind during flight and travel short, the balls preferably have a weight of 44 to 45.9 g.

The wound golf balls of the invention are improved in flight distance and control. Even when solid centers are molded using a mold having a number of cavities, they have little variations with respect to hardness and weight. This enables golf balls to be produced to consistent quality.

EXAMPLE

Examples of the invention are given below by way of illustration, and are not intended to limit the invention. All parts are by weight.

Examples & Comparative Examples

Each of the resin compositions shown in Table 1 was kneaded in a twin screw extruder. It was injection molded using an injection mold having 4 cavities. For each composition, fifty (50) solid centers were prepared.

The rubber composition shown in Table 2 was kneaded in a kneader. It was molded and vulcanized at 155° C. for 15 minutes using an mold having 50 cavities. Fifty (50) solid centers were prepared.

The thus prepared solid centers were measured for outer diameter, weight, hardness and rebound. The results are also shown in Tables 1 and 2.

Hardness

A deflection (mm) of the solid center under an applied load of 50 kg.

Rebound

A rebound height (cm) when the solid center was dropped from a height of 120 cm.

Variations of weight and hardness

The difference between maximum and minimum values for fifty solid centers.

A rubber thread of the composition and parameters shown below was wound on each solid center while the rubber thread was stretched by about 8 folds. Wound cores having a diameter of about 38.1 mm were obtained.

| Rubber thread | |
|---|---|
| Polyisoprene rubber | 70 parts |
| Natural rubber | 30 parts |
| Zinc oxide | 1.5 parts |
| Stearic acid | 1 part |
| Vulcanization accelerator | 1.5 parts |
| Sulfur | 1 part |
| Specific gravity | 0.93 |
| Dimensions | |
| Width | 1.55 mm |
| Thickness | 0.55 mm |

Each of cover stocks of the compositions shown in Table 3 was kneaded in a twin screw extruder and molded into hemispherical half cups for a cover inner layer. Each wound core was enclosed in a pair of half cups in accordance with the combination shown in Table 5. This was compression molded at 145° C., followed by deburring. In this way, the cover inner layer was formed around the wound core.

A urethane adhesive shown below was applied to the cover inner layer on the wound core and dried. Ingredients shown in Table 4 were kneaded, extruded and out into pellets by means of a twin screw extruder. This cover stock for a cover outer layer was melted and injected around the cover inner layer on the wound core. In this way, a wound golf ball having the cover of inner and outer layers on the wound core was obtained. At the same time as the injection molding step, dimples of three types were formed in a total number of 392, a dimple surface coverage of 78%, and a percent dimple volume of 0.88%.

Adhesive

Two-part curable aqueous urethane adhesive

Base: amine-terminated carboxyl-bearing compound in aqueous medium

Curing agent: polycarbodiimide crosslinker

Base/curing agent/water=100/5/5 in weight ratio

In each Example, there were produced fifty wound golf balls, from which twelve balls were randomly selected and tested as follows. The results are shown in Table 5.

Flight performance

Using a swing robot by True Temper Co., the ball was hit with a driver at a head speed of 45 m/s (#W1/HS45). Spin,

TABLE 1

| Solid center type | | | A | B | C | D | E | F |
|---|---|---|---|---|---|---|---|---|
| Composition (pbw) | Hytrel 3078 | | 100 | | 50 | 50 | | 100 |
| | Hytrel 4001 | | | 100 | 50 | 50 | | |
| | Hytrel 4701 | | | | | | 100 | |
| | Zinc oxide | | 10 | | 8 | 3 | | 20 |
| Solid center | Outer diameter (mm) | Ave. | 32.0 | 33.0 | 32.0 | 33.0 | 32.0 | 32.0 |
| | Weight (g) | Ave. | 19.9 | 21.1 | 19.9 | 21.0 | 19.8 | 21.2 |
| | | Var. | 0.2 | 0.2 | 0.2 | 0.3 | 0.2 | 0.2 |
| | Hardness (mm) | Ave. | 4.10 | 2.20 | 3.05 | 3.15 | 1.45 | 3.95 |
| | | Var. | 0.17 | 0.08 | 0.13 | 0.11 | 0.07 | 0.15 |
| | Rebound (cm) | Ave. | 97.0 | 95.8 | 96.3 | 96.5 | 90.5 | 93.5 |

Hytrel 3078, 4001 and 4701 are thermoplastic polyester elastomers commercially available from Toray-DuPont K.K.

TABLE 2

| Solid center type | | | G |
|---|---|---|---|
| Composition (pbw) | Cis-1,4-polybutadiene rubber | | 100 |
| | Zinc acrylate | | 20.0 |
| | Zinc oxide | | 19.0 |
| | Barium sulfate | | 19.0 |
| | Dicumyl peroxide | | 1.2 |
| Solid center | Outer diameter (mm) | Ave. | 31.9 |
| | Weight (g) | Ave. | 21.4 |
| | | Var. | 0.7 |
| | Hardness (mm) | Ave. | 2.65 |
| | | Var. | 0.48 |
| | Rebound (cm) | Ave. | 98.0 |

initial velocity, launch angle, elevation angle, carry and total distance were measured.

Hardness

A deflection (mm) of the ball under an applied load of 100 kg.

Variations of weight and hardness

The difference between maximum and minimum values for fifty balls.

Variation of carry

The difference between maximum and minimum values for twelve balls.

TABLE 3

| Cover inner layer type | | I | J |
|---|---|---|---|
| Composition (pbw) | Himilan 1706 | 50 | 50 |
| | Himilan 1605 | 50 | 50 |
| | Titanium oxide | 3 | 3 |
| | Barium sulfate | 34 | — |
| | Dispersant | 1.0 | 1.0 |
| | Pigment | 0.01 | 0.01 |
| Cover inner layer | Specific gravity | 1.20 | 0.97 |
| | Hardness (Shore D) | 62 | 61 |
| | MFR (g/min, 190° C.) | 1.85 | 1.90 |

Himilan 1706 and 1605: ionomer resins by Mitsui-DuPont Polychemicals K.K.

MFR: melt flow index at 190° C.

TABLE 4

| Cover outer layer type | | H |
|---|---|---|
| Composition (pbw) | Pandex T-7890 | 100 |
| | Tianium oxide | 5.0 |

TABLE 4-continued

| Cover outer layer type | | H |
|---|---|---|
| | Dispersant | 1.0 |
| | Pigment | 0.01 |
| Cover outer layer | Specific gravity | 1.21 |
| | Hardness (Shore D) | 42 |
| | MFR (g/min, 190° C.) | 5.7 |

Pandex T-7890: non-yellowing thermoplastic polyurethane elastomer by Dai-Nippon Ink & Chemicals K.K.

TABLE 5

| | | | Example | | | | Comparative Example | | | |
|---|---|---|---|---|---|---|---|---|---|---|
| | | | 1 | 2 | 3 | 4 | 1 | 2 | 3 | 4 |
| Solid center | Type | | A | B | C | D | E | F | G | A |
| | Outer diameter (mm) | | 32.0 | 33.0 | 32.0 | 33.0 | 32.0 | 32.0 | 31.9 | 32.0 |
| | Weight (g) | | 19.9 | 21.1 | 19.9 | 21.0 | 19.8 | 21.2 | 21.4 | 19.9 |
| | Hardness (mm @ 50 kg) | | 4.08 | 2.20 | 3.05 | 3.15 | 1.45 | 3.95 | 2.65 | 4.08 |
| | Rebound (cm) | | 97.0 | 95.8 | 96.3 | 96.5 | 90.5 | 93.5 | 98.0 | 97.0 |
| Cover outer layer | Type | | H | H | H | H | H | H | H | H |
| | Specific gravity | | 1.21 | 1.21 | 1.21 | 1.21 | 1.21 | 1.21 | 1.21 | 1.21 |
| | Shore D hardness | | 42 | 42 | 42 | 42 | 42 | 42 | 42 | 42 |
| | Gage (mm) | | 1.4 | 1.4 | 1.4 | 1.4 | 1.4 | 1.4 | 1.4 | 1.4 |
| Cover inner layer | Type | | I | I | I | I | I | J | I | J |
| | Specific gravity | | 1.20 | 1.20 | 1.20 | 1.20 | 1.20 | 0.97 | 1.20 | 0.97 |
| | Shore D hardness | | 62 | 62 | 62 | 62 | 62 | 61 | 62 | 61 |
| | Gage (mm) | | 0.9 | 0.9 | 0.9 | 0.9 | 0.9 | 0.9 | 0.9 | 0.9 |
| Rubber thread | Weight (g) | | 8.7 | 7.7 | 8.7 | 7.6 | 8.7 | 8.7 | 8.8 | 8.7 |
| Ball (average of 50 balls) | Outer diameter (mm) | | 42.69 | 42.69 | 42.68 | 42.68 | 42.69 | 42.68 | 42.68 | 42.68 |
| | Weight (g) | Ave. | 45.4 | 45.4 | 45.4 | 45.3 | 45.3 | 45.2 | 45.2 | 43.8 |
| | | Var. | 0.2 | 0.2 | 0.2 | 0.2 | 0.2 | 0.2 | 0.7 | 0.2 |
| | Hardness (mm @ 100 kg) | Ave. | 2.95 | 3.02 | 2.90 | 3.08 | 2.91 | 2.95 | 2.95 | 3.00 |
| | | Var. | 0.14 | 0.13 | 0.15 | 0.16 | 0.11 | 0.16 | 0.36 | 0.15 |
| #W1/HS45 (average of 12 balls) | Spin (rpm) | | 2550 | 2590 | 2610 | 2480 | 2410 | 2500 | 2620 | 2650 |
| | Initial velocity (m/s) | | 65.5 | 65.3 | 65.5 | 65.5 | 64.7 | 65.1 | 65.6 | 65.8 |
| | Elevation angle (°) | | 12.1 | 12.0 | 12.2 | 12.0 | 11.6 | 11.8 | 12.2 | 12.5 |
| | Carry (m) | Ave. | 205.8 | 205.0 | 206.5 | 205.5 | 202.1 | 203.9 | 206.4 | 208.7 |
| | | Var. | 4.1 | 3.8 | 4.8 | 4.6 | 3.5 | 3.8 | 8.5 | 5.2 |
| | Total (m) | | 222.8 | 222.0 | 223.0 | 223.8 | 213.7 | 214.8 | 221.3 | 218.1 |

It is evident from the data of Table 5 that wound golf balls within the scope of the invention are minimized in variations of the hardness and weight among the solid centers prepared from a common mold, and improved in spin, initial velocity, carry and total distance.

In contrast, the wound golf balls of Comparative Example 1 in which the solid centers have a deflection and a rebound height both below the range of the invention and the wound golf balls of Comparative Example 2 in which the solid centers have a rebound height below the range of the invention are poor in initial velocity and flight distance. As to the wound golf balls of Comparative Example 3 having solid centers of the rubber composition, the hardness and weight are considerably diverse among the solid centers prepared from a common mold, and the carry is considerably diverse among the balls. The wound golf balls of Comparative Example 4 in which the cover has a specific gravity below the range of the invention show varying carries and shorter flight distances.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A wound golf ball comprising; a wound core consisting of a solid center and a thread rubber layer thereon, and a cover surrounding the wound core, wherein said solid center is composed of a thermoplastic polyester customer and one or more inorganic fillers are blended in an amount of less than 20 parts by weight per 100 parts by weight of the thermoplastic polyester elastomer and said solid center has an outer diameter of 31 to 34 mm, a deflection of 1.8 to 4.5 mm under an applied load of 50 kg, and a rebound height of 95 to 105 cm when dropped from a height of 120 cm, and said cover has a specific gravity of 1.05 to 1.4 and a gate of 1.5 to 3 mm.

2. The wound golf ball of claim 1 wherein said solid center is provided at its surface with fine asperities.

3. The wound golf ball of claim 1, wherein said solid center has an outer diameter of 32 to 33 mm.

4. A wound golf ball of claim 1, wherein said solid center has a specific gravity in the range of 0.93 to 1.1.

5. A wound golf ball of claim 1, wherein said cover comprises a single layer.

6. A wound golf ball of claim 1, wherein said cover comprises a plurality of layers.

7. A wound golf ball of claim 6, wherein a ratio of thickness of an inner cover layer to an outer cover layer is in the range from 7:3 to 3:7.

8. A wound golf ball of claim 1, wherein said cover has a Shore D hardness in the range of 55 to 65.

9. A wound golf ball of claim 6, wherein a difference in hardness between an inner cover layer and an outer cover layer is at least 5 Shore D units.

10. A wound golf ball of claim 6, wherein a cover outer has a Shore D hardness in a Shore D range of 38 to 55 and a cover inner layer has a Shore D hardness in a range of 55 to 65.

* * * * *

UNITED STATES PATENT AND TRADEMARK OFFICE

CERTIFICATE OF CORRECTION

PATENT NO. : . 6,083 ,120

DATED : July 4, 2000

INVENTOR(S) : Junji UMEZAWA and Shinichi KAKIUCHI

It is certified that error appears in the above-identified patent and that said Letters Patent is hereby corrected as shown below:

Title page, item

[73] Assignee: Bridgestone Sports Co., Ltd., Tokyo, Japan

Signed and Sealed this

First Day of May, 2001

*Attest:*

Nicholas P. Godici

NICHOLAS P. GODICI

*Attesting Officer*

*Acting Director of the United States Patent and Trademark Office*